US008267674B2

(12) United States Patent
Czulak et al.

(10) Patent No.: US 8,267,674 B2
(45) Date of Patent: Sep. 18, 2012

(54) CENTRIFUGAL BLOWER ASSEMBLY

(75) Inventors: Alexander Czulak, Wayland, MA (US); Thomas R. Chapman, Templeton, MA (US)

(73) Assignee: Robert Bosch GmbH, Stuttgart (DE)

( * ) Notice: Subject to any disclaimer, the term of this patent is extended or adjusted under 35 U.S.C. 154(b) by 317 days.

(21) Appl. No.: 12/700,026

(22) Filed: Feb. 4, 2010

(65) Prior Publication Data

US 2011/0189033 A1 Aug. 4, 2011

(51) Int. Cl.

| | |
|---|---|
| ***F04B 17/00*** | (2006.01) |
| ***F04B 35/00*** | (2006.01) |
| ***F04B 39/06*** | (2006.01) |
| ***F04B 35/04*** | (2006.01) |
| ***F04B 39/02*** | (2006.01) |

(52) U.S. Cl. ..... 417/370; 417/423.14

(58) Field of Classification Search ..... 417/423.8, 417/423.14, 366, 370

See application file for complete search history.

(56) References Cited

U.S. PATENT DOCUMENTS

| | | | | |
|---|---|---|---|---|
| 3,274,410 | A | 9/1966 | Boivie | |
| 4,111,615 | A | 9/1978 | Watanabe | |
| 4,184,804 | A | 1/1980 | Inagaki et al. | |
| 4,186,317 | A | 1/1980 | Sisk | |
| 4,626,720 | A | 12/1986 | Fukasaku et al. | |
| 5,375,651 | A | 12/1994 | Colwell | |
| 5,714,819 | A | 2/1998 | Gilliland et al. | |
| 5,743,721 | A * | 4/1998 | Graham et al. | 415/58.4 |
| 5,814,908 | A | 9/1998 | Muszynski | |
| 5,944,497 | A | 8/1999 | Kershaw et al. | |
| 5,954,488 | A | 9/1999 | Graham et al. | |
| 6,166,462 | A | 12/2000 | Finkenbinder et al. | |
| 6,351,046 | B1 | 2/2002 | Bradfield | |
| 6,384,494 | B1 | 5/2002 | Avidano et al. | |
| 6,561,772 | B2 | 5/2003 | Volkert et al. | |
| 6,802,699 | B2 * | 10/2004 | Mikami et al. | 417/369 |
| 6,997,686 | B2 | 2/2006 | Agrawal et al. | |
| 7,011,506 | B2 * | 3/2006 | Kim | 417/366 |
| 7,016,195 | B2 | 3/2006 | Ito et al. | |
| 7,037,084 | B2 | 5/2006 | King | |
| 7,037,089 | B2 | 5/2006 | Hsieh | |
| 7,118,355 | B2 * | 10/2006 | Lipa et al. | 417/370 |
| 7,453,696 | B2 | 11/2008 | Tungl et al. | |
| 7,554,239 | B2 * | 6/2009 | Suzuki | 310/239 |
| 7,780,405 | B2 * | 8/2010 | Araki | 415/204 |
| 2005/0053495 | A1 | 3/2005 | Lebecq et al. | |
| 2006/0177322 | A1 * | 8/2006 | Lipa et al. | 417/423.1 |
| 2006/0192449 | A1 * | 8/2006 | Noda et al. | 310/88 |

OTHER PUBLICATIONS

The International Search Report and the Written Opinion regarding PCT/US2011/023133 dated Apr. 12, 2011, 14 pages.

* cited by examiner

*Primary Examiner* — Devon Kramer
*Assistant Examiner* — Thomas Fink
(74) *Attorney, Agent, or Firm* — Michael Best & Friedrich LLP

(57) ABSTRACT

A motor housing includes a motor support portion defining a central axis and including a first end and a second end, a wall surrounding the motor support portion, a surface offset from the wall toward the second end in a direction parallel with the central axis, a cooling air passageway oriented generally parallel with the central axis and offset from the central axis, and an inlet, opening directly into the cooling air passageway, at least partially defined between the wall and the surface. The inlet is configured to permit entry of a tangential airflow into the cooling air passageway, and the inlet is configured to permit entry of a radial airflow into the cooling air passageway.

20 Claims, 4 Drawing Sheets

CENTRIFUGAL BLOWER ASSEMBLY

FIELD OF THE INVENTION

The present invention relates to centrifugal blower assemblies, and more particularly to centrifugal blower assemblies used in vehicle heating, ventilation, and cooling systems.

BACKGROUND OF THE INVENTION

Conventional centrifugal blower assemblies utilized in vehicle heating, ventilation, and cooling ("HVAC") systems typically include a volute, an electric motor and motor housing supported by the volute, and a centrifugal blower driven by the motor. A cooling air passageway is typically defined by the motor housing and the volute to provide cooling air to the motor during operation of the centrifugal blower assembly. The inlet of the cooling air passageway is typically positioned at a large radius with respect to the axis of rotation of the centrifugal blower near the outlet of the volute (i.e., in a region of relatively high static pressure). The inlet of the cooling air passageway is typically an opening flush with the surface of the volute. Consequently, the inlet of the cooling air passageway is capable of drawing a cooling airflow from the outlet of the volute by taking advantage of the relatively high static pressure near the outlet of the volute. However, the inlet of the cooling air passageway cannot effectively capture the moving air near the outlet of the volute, and therefore take advantage of the relatively high dynamic pressure near the outlet of the volute.

SUMMARY OF THE INVENTION

The present invention provides, in one aspect, a motor housing for use with a centrifugal blower assembly. The motor housing includes a motor support portion defining a central axis and including a first end and a second end, a wall surrounding the motor support portion, a surface offset from the wall toward the second end in a direction parallel with the central axis, a cooling air passageway oriented generally parallel with the central axis and offset from the central axis, and an inlet, opening directly into the cooling air passageway, at least partially defined between the wall and the surface. The inlet is configured to permit entry of a tangential airflow into the cooling air passageway, and the inlet is configured to permit entry of a radial airflow into the cooling air passageway.

The present invention provides, in another aspect, a centrifugal blower assembly including a volute and a motor housing coupled to the volute. The motor housing includes a motor support portion defining a central axis and including a first end and a second end, a wall surrounding the motor support portion, a surface offset from the wall toward the second end in a direction parallel with the central axis, a cooling air passageway oriented generally parallel with the central axis and offset from the central axis, and an inlet, opening directly into the cooling air passageway, at least partially defined between the wall and the surface and configured to permit entry of a tangential airflow and a radial airflow into the cooling air passageway. The centrifugal blower assembly also includes a motor supported by the motor housing and having an output shaft, and a centrifugal blower coupled to the output shaft for co-rotation with the output shaft.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
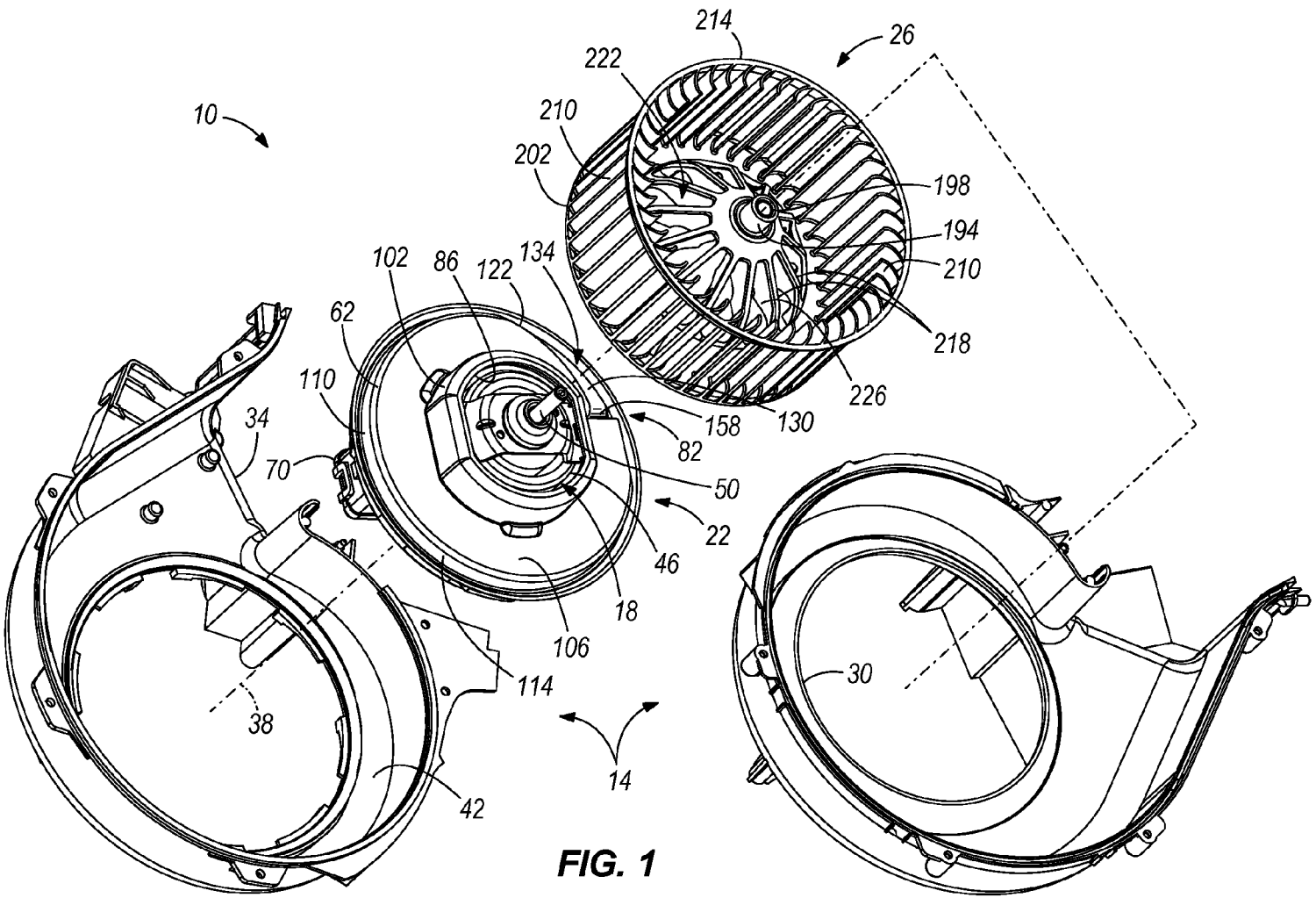
FIG. 1 is an exploded perspective view of a centrifugal blower assembly of the invention.

With reference to FIG. 1, a centrifugal blower assembly 10 includes a volute 14, a motor 18 and motor housing 22 supported by the volute 14, and a centrifugal blower 26 drivably coupled to the motor 18 to create an airflow through the volute 14. The volute 14 includes an inlet 30 and an outlet 34 oriented substantially normal to the inlet 30, such that an airflow is drawn by the centrifugal blower 26 through the inlet 30 in an axial direction with respect to an axis 38 of rotation of the centrifugal blower 26 and discharged through the outlet 34 in a radial direction with respect to the axis 38 of rotation of the centrifugal blower 26.

In the illustrated construction of the centrifugal blower assembly 10, the volute 14 is formed of two pieces which, when assembled, define a scroll 42 within which the airflow created by the blower 26 flows. Alternatively, the volute 14 may be formed from any of a number of different pieces or as a single piece. As is understood by one of ordinary skill in the art, the scroll 42 defines a progressively increasing cross-sectional area from the beginning of the scroll 42 (i.e., where the cross-sectional area of the scroll 42 is at a minimum value) leading to the outlet 34 of the volute 14 (i.e., where the cross-sectional area of the scroll is at a maximum value) to facilitate expansion of the airflow as it flows from the beginning of the scroll 42 to the outlet 34.

Figure 4:
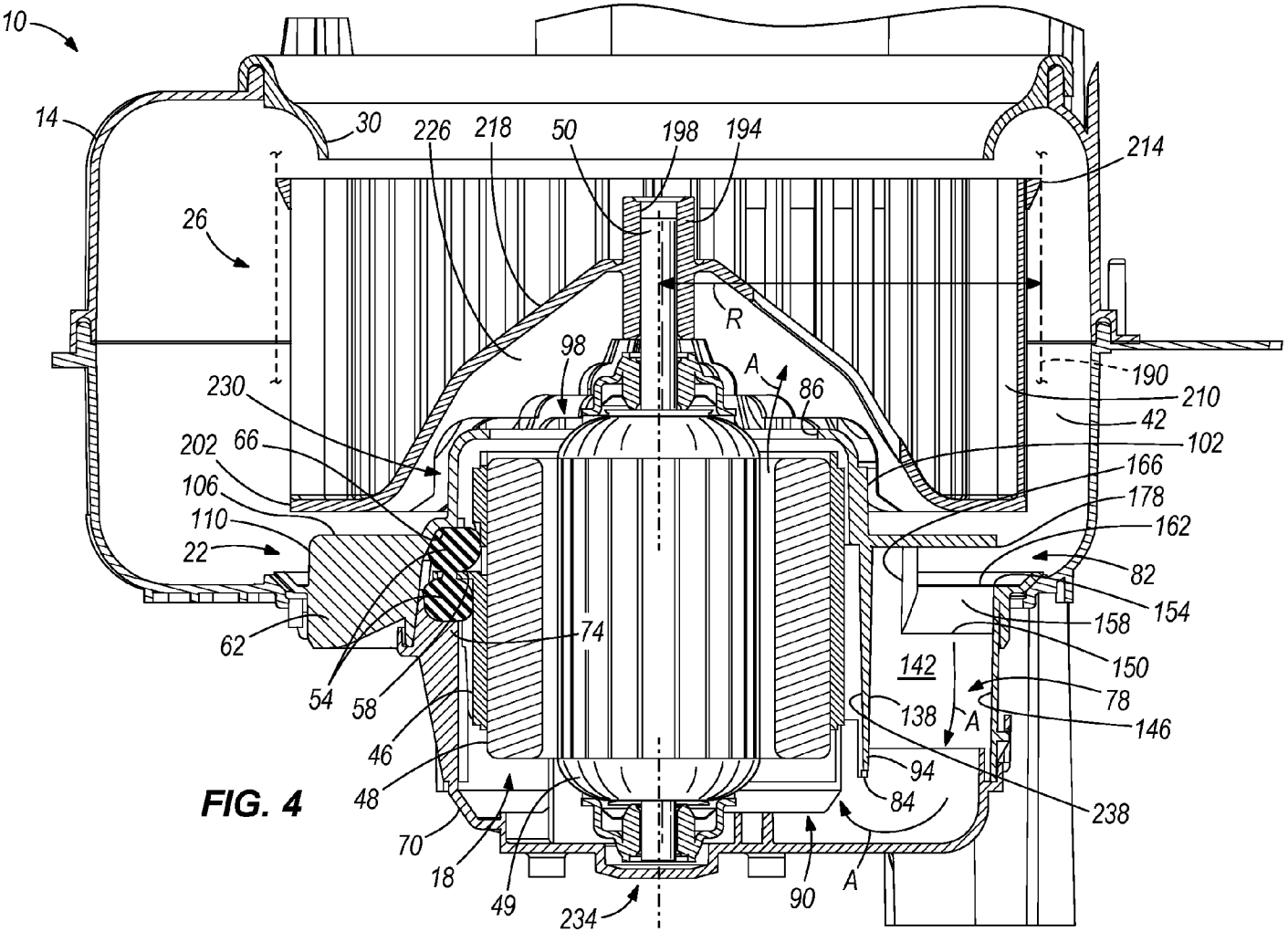
FIG. 4 is an assembled, cross-sectional view of the centrifugal blower assembly of FIG. 1

With reference to FIG. 4, the motor 18 is configured as an open-frame electric motor 18 having an outer can 46, a stator 48 consisting of a plurality of permanent magnets, an armature 49 consisting of a plurality of windings, and an output shaft 50 co-rotating with the armature 49 and protruding from the can 46. As shown in FIG. 4, a radial gap exists between the stator 48 and the armature 49 through which an airflow may pass to cool the internal components of the motor 18 (e.g., the stator 48, the armature 49, commutator brushes, etc.). Alternatively, the outer can 46 may be substantially closed, and the motor 18 may be configured as a can-style electric motor.

With continued reference to FIG. 4, the motor housing 22 couples the motor 18 to the volute 14 and also maintains the output shaft 50 of the motor 18 (and therefore the centrifugal blower 26) in coaxial alignment with the inlet 30 of the volute 14. The motor 18 includes a plurality of vibration isolation elements 54 positioned between the outer can 46 and the motor housing 22 to reduce the amount of vibration transferred from the motor 18 to the motor housing 22 and to coaxially align the output shaft 50 with the inlet 30 of the volute 14. In the illustrated construction of the assembly 10, the vibration isolation elements 54 are configured as elastomeric (i.e., rubber) balls or spheres, and interconnected pairs of elements 54 are supported on the outer can 46 by respective tabs 58 (only one of which is shown in FIG. 4). Alternatively, the elements 54 may have a different configuration than that shown in FIG. 4.

The motor housing 22 includes an upper portion 62 having a plurality of slots or pockets 66 (only one of which is shown in FIG. 4) spaced about the central axis 38 at equal or unequal intervals in which the respective pairs of vibration isolation elements 54 are at least partially received. The motor housing 22 also includes a lower portion 70 coupled to the upper portion 62 (e.g., using a snap-fit, using fasteners, by welding, using adhesives, etc.) and having a corresponding plurality of fingers 74 that are engaged with the lower element 54 in each of the pairs of elements 54 to clamp the pairs of elements 54 between the upper portion 62 and the lower portion 70 of the motor housing 22, thereby axially securing the motor 18 to the motor housing 22.

With continued reference to FIG. 4, a combination of the upper and lower portions 62, 70 of the motor housing 22 defines a motor support portion 102 having a first, at least partially open end 230 and a second, closed end 234 defining the central axis 38 therebetween. The motor support portion 102 includes a cavity 238 in which the motor 18 is positioned.

Figure 2:
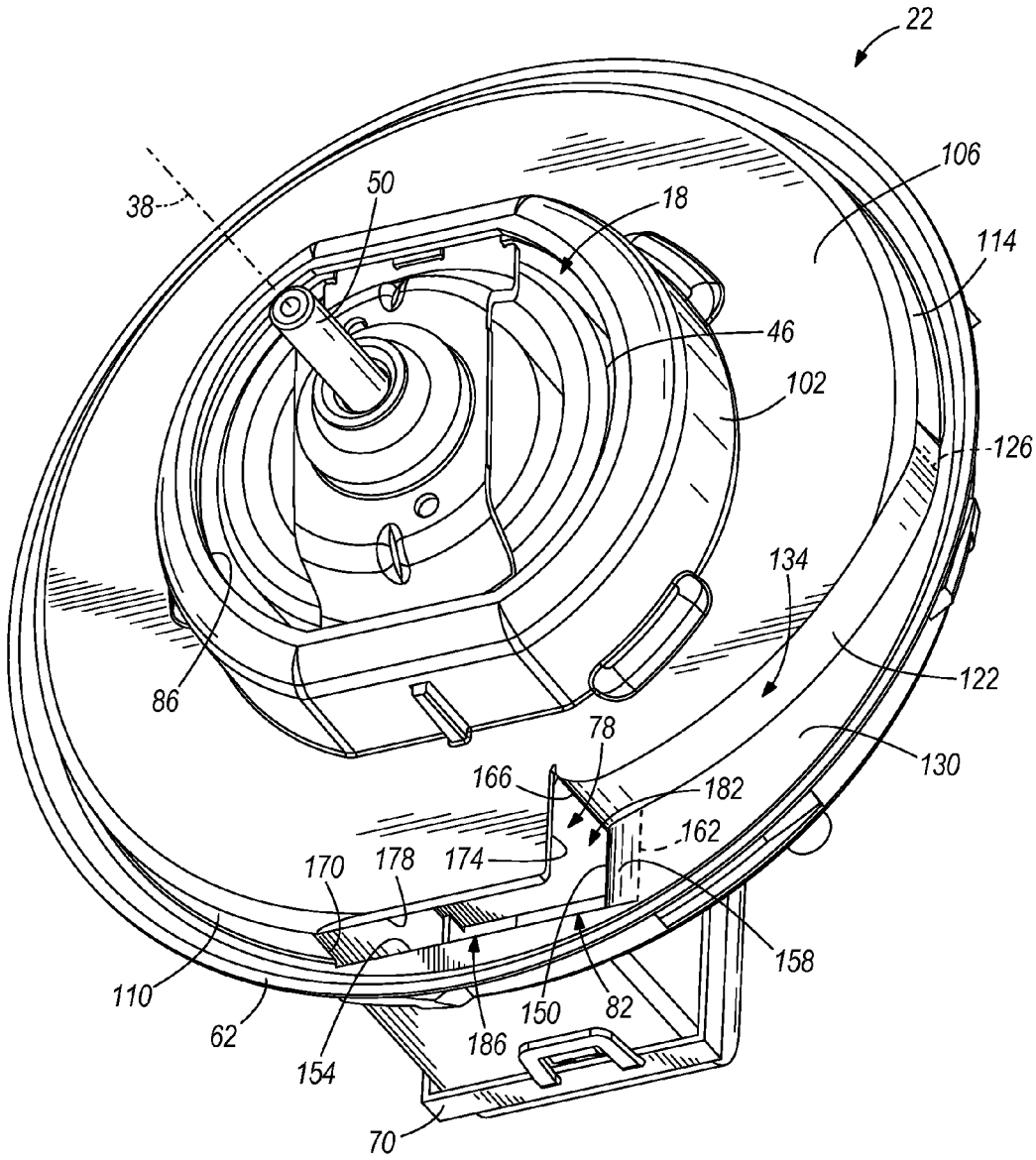
FIG. 2 is a top perspective view of a motor housing of the centrifugal blower assembly of the invention.

With reference to FIGS. 2 and 4, the motor housing 22 includes a cooling air passageway 78 in fluid communication with the cavity 238 and an inlet 82 opening directly into the cooling air passageway 78. The motor housing 22 also includes an outlet 84, defined between an interior wall 94 separating the passageway 78 from the motor cavity 238 and the lower portion 70 of the housing 22, fluidly communicating the passageway 78 with the cavity 238. The first end 230 of the motor housing 22 also includes a discharge opening 86 in facing relationship with the underside of the centrifugal blower 26. As is described in greater detail below, during operation of the centrifugal blower assembly 10, some of the airflow in the scroll 42 is diverted from the scroll 42 to the cooling air passageway 78 via the inlet 82. From the inlet 82, the airflow is directed through the cooling air passageway 78 toward a bottom end 90 of the motor 18. The airflow then exits the passageway 78 through the outlet 84 and is redirected upwardly, around an interior wall 94 of the housing 22, through the cavity 238 toward a top end 98 of the motor 18. Because the motor 18 is configured as an open-frame motor 18, the airflow is allowed to pass through the interior of the can 46 to cool the internal components (e.g., the stator 48, the armature 49, commutator brushes, etc.) of the motor 18. The airflow through the cooling air passageway 78 and the cavity 238 is represented by the series of arrows A in FIG. 4. The resultant heated airflow exits the housing 22 through the discharge opening 86. Should a can-style motor be employed rather than the illustrated open-frame motor 18, the airflow may pass through the space or gap between the radially outermost surface of the can and a facing interior surface of the motor housing 22 (i.e., around the radially outermost surface of the can).

With reference to FIG. 2, the motor housing 22 also includes an upper axial-facing wall 106 surrounding and extending from the motor support portion 102. The wall 106 is oriented substantially normal to the central axis 38 and is in facing relationship with the centrifugal blower 26. The outer periphery of the top end 98 of the motor 18 is substantially enclosed by the motor support portion 102 (FIG. 4). The motor housing 22 further includes an outer wall 110 disposed adjacent and radially outwardly of the wall 106. The outer wall 110 includes a first portion 114 defining at least a portion of a cylinder 118 (FIG. 3) coaxial with the central axis 38, and a second portion 122 spanning between the inlet 82 and the first portion 114 (FIG. 2). In the illustrated construction of the centrifugal blower assembly 10, both the first and second portions 114, 122 of the outer wall 110 are oriented substantially normal to the upper axial-facing wall 106. Alternatively, either of the portions 114, 122 of the outer wall 110 may be oriented obliquely with respect to the upper axial-facing wall 106.

Figure 3:
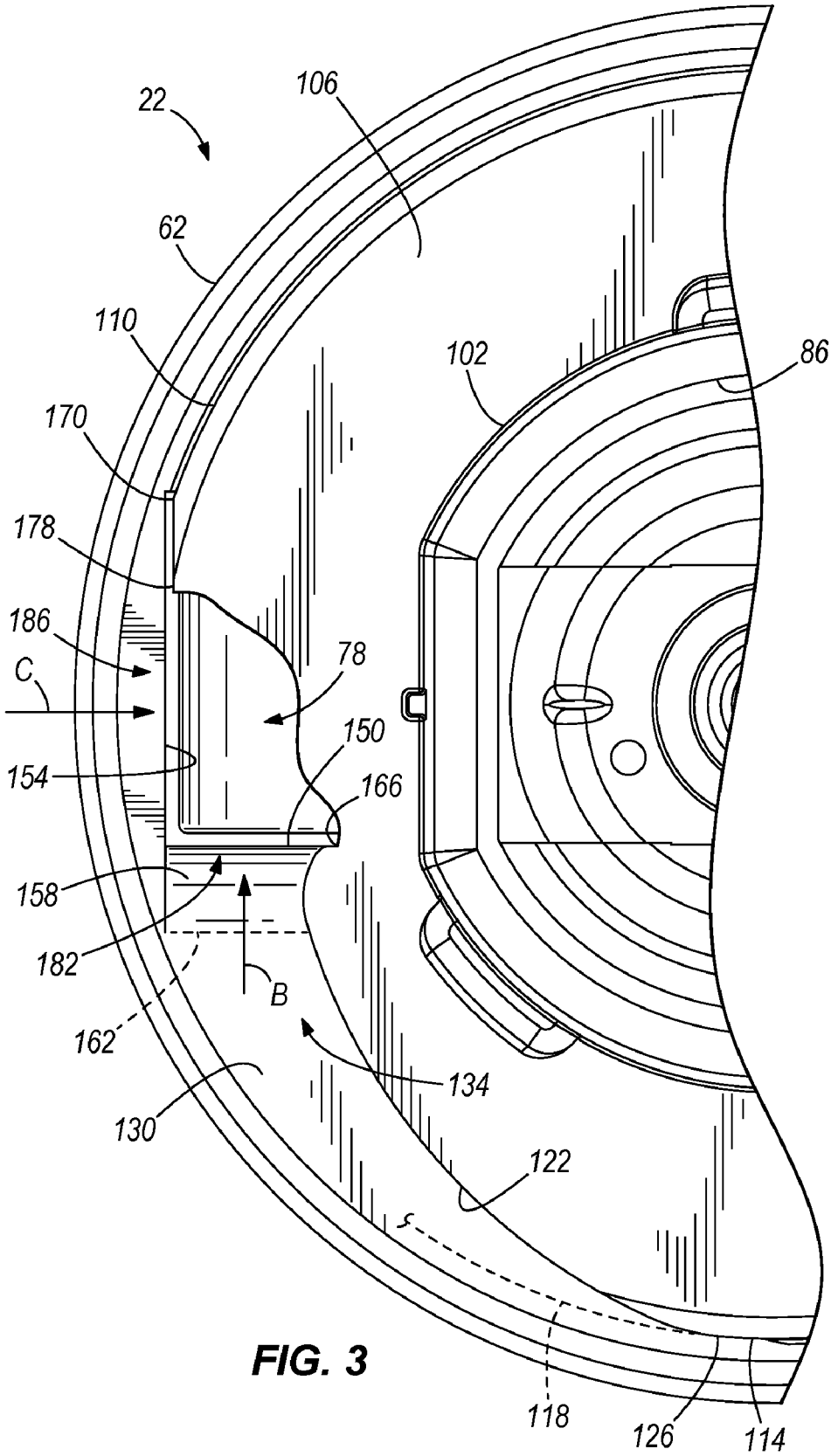
FIG. 3 is a top, partial cutaway view of the motor housing of FIG. 2.

As shown in FIGS. 2 and 3, the second portion 122 of the wall 110 deviates from the cylinder 118 in a direction toward the central axis 38. In the illustrated construction of the centrifugal blower assembly 10, the first and second portions 114, 122 of the wall 110 are demarcated by a transition, schematically illustrated with a dashed line 126, where the second portion 122 of the wall 110 deviates from the cylinder 118. In the illustrated construction of the centrifugal blower assembly 10, the first and second portions 114, 122 of the wall 110 are blended together such that the transition 126 does not appear as a distinct line. The second portion 122 of the wall 110 includes an arcuate shape that may be defined by any of a number of different mathematical relationships with respect to the axis 38 (e.g., a continually decreasing radius having an origin coaxial with or offset from the axis 38). Alternatively, at least a portion of the second portion 122 of the wall 110 may include a planar or flat shape. As a further alternative, the transition 126 may appear as a distinct line on the wall 110.

With reference to FIG. 2, the motor housing 22 also includes a lower axial-facing surface or wall 130 adjacent the outer wall 110. The wall 130 is also oriented substantially normal to the second portion 122 of the wall 110. Further, the wall 130 is substantially parallel with the upper axial-facing wall 106 and is axially offset from the wall 130 toward the second end 234 of the motor support portion 102 in a direction parallel to the central axis 38. Alternatively, the wall 130 may be non-parallel with the wall 106. As is described in more detail below, a combination of the second portion 122 of the outer wall 110 and the lower axial-facing wall 130 define an inlet path 134 upstream of and leading toward the inlet 82 of the cooling air passageway 78.

With reference to FIG. 4, the cooling air passageway 78 is oriented generally parallel with the central axis 38 and is spaced or offset from the central axis 38. In the illustrated construction of the centrifugal blower assembly 10, the cooling air passageway 78 includes four interconnected orthogonal surfaces 138, 142, 146 (three of which are shown in FIG. 4) imparting a substantially rectangular shape to the cooling air passageway 78. Alternatively, the surfaces 138, 142, 146 need not be orthogonal to each other, and the cooling air passageway 78 may be shaped in any of a number of different ways. The surface 138 is defined by the interior wall 94 and is adjacent an underside of the upper axially-facing wall 106. The surfaces 142, 146 are bounded by respective edges 150, 154 that are oriented substantially normal to each other (see also FIG. 3). The inlet 82 is disposed adjacent the upper axial-facing wall 106 (i.e., beneath the wall 106 from the point of view of FIG. 4) and is at least partially defined by the two edges 150, 154. Also, in the illustrated construction of the centrifugal blower assembly 10, the motor housing 22 includes a ramp 158 at least partially bounded by the edge 150 and an edge 162 of the lower axially-facing surface 130. Alternatively, the ramp 158 may be omitted, and the edge 150 may be shared between the surface 142 and the lower axially-facing wall 130.

With reference to FIG. 2, in addition to being defined by the edges 150, 154, the inlet 82 is also at least partially defined by opposite edges 166, 170 of the outer wall 110, and by respective edges 174, 178 of the upper axially-facing wall 106 that are oriented substantially normal to each other. As such, the inlet 82 is substantially L-shaped, such that an airflow (designated with arrow B; FIG. 3) may directly enter the passageway 78 through a first side 182 of the inlet 82, and another airflow (designated with arrow C) may directly enter the passageway 78 through a second side 186 of the inlet 82 (FIG. 2), in which the respective sides 182, 186 are oriented substantially normal to each other.

In other words, the inlet 82 is configured to permit entry of a generally tangential airflow (arrow B in FIG. 3) and a generally radial airflow (arrow C) directly into the passageway 78. Although the tangential and radial airflows designated by arrows B and C, respectively, are shown oriented substantially normal to each other, one of ordinary skill in the art would understand that the airflows passing through the first and second sides 182, 186 of the inlet 82 may deviate from the illustrated directions. Accordingly, as used herein, a "tangential" airflow may be considered as any airflow swirling around the central axis 38 and flowing over the edge 150 prior to entering the passageway 78. Likewise, as used herein, a "radial" airflow may be considered as any airflow flowing generally toward the central axis 38 and flowing over the edge 154 prior to entering the passageway 78. In an alternative embodiment of the assembly 10, the single inlet 82 may be separated into two distinct openings coinciding with the respective sides 182, 186.

With reference to FIG. 1, the centrifugal blower 26 includes a hub 194 coupled to the output shaft 50 of the motor 18. In the illustrated construction of the centrifugal blower assembly 10, the hub 194 includes a central bore 198 coaxial with the axis 38 and sized to provide an interference fit with the output shaft 50 when coupled to the motor 18 (FIG. 4). The interference fit is sufficient to substantially prevent relative movement (i.e., in both a rotational direction and an axial direction) between the blower 26 and the output shaft 50. Alternatively, any of a number of different processes (e.g., welding, brazing, adhering, etc.) may be employed in place of the interference fit to rotationally and axially secure the hub 194 to the output shaft 50. As a further alternative, the tip of the output shaft 50 may be configured having a non-circular cross-section, and the central bore 198 may include a corresponding non-circular cross-section to fix the blower 26 for co-rotation with the output shaft 50. In conjunction with this alternative construction, a threaded aperture may be formed in the tip of the output shaft 50, and a threaded fastener (e.g., a bolt or a screw) may be received in the central bore 198 and the threaded aperture to axially secure the hub 194, and therefore the centrifugal blower 26, to the output shaft 50. As yet another alternative, a separate adapter may be utilized to couple the hub 194 and the output shaft 50.

With reference to FIGS. 1 and 4, the centrifugal blower 26 includes an outer rim 202 that is concentric with the hub 194. As shown in FIG. 4, the hub 194 is also axially spaced from the outer rim 202, rather than being co-planar with the outer rim 202. This allows at least a portion of the motor 18 to fit inside the centrifugal blower 26. Alternatively, the hub 194 may be positioned coplanar with the outer rim 202, such that no portion of the motor 18 may fit inside the centrifugal blower 26.

With reference to FIGS. 1 and 4, the centrifugal blower 26 also includes a plurality of blades 210 coupled to the outer rim 202 and extending away from the outer rim 202 in a direction toward the top end of the centrifugal blower 26 and substantially parallel with the axis 38. The centrifugal blower 26 also includes a band 214 interconnecting the top edges of the blades 210. As discussed above, the blades 210 are oriented with respect to the hub 194 to draw an airflow into the middle of the centrifugal blower 26 in a direction substantially parallel with the axis 38, and discharge the airflow in a radial direction with respect to the axis 38.

With reference to FIG. 4, the inlet 82 is entirely disposed within a cylinder 190 coinciding with an outermost radius R of the centrifugal blower 26. In the illustrated construction of the centrifugal blower assembly 10, the outermost radius R coincides with the outermost radius of the band 214. Alternatively, the outermost radius R may coincide with other portions of the blower 26 (e.g., the rim 202). As a further alternative, a portion of the inlet 82 may be positioned outside the cylinder 190 coinciding with the outermost radius R of the blower 26.

With continued reference to FIGS. 1 and 4, the centrifugal blower 26 also includes a plurality of spokes 218 interconnecting the hub 194 and the outer rim 202. The spokes 218 structurally support the outer rim 202, the blades 210, and the band 214 on the hub 194. In addition, torque from the motor 18 is transferred from the hub 194 to the outer rim 202 via the spokes 218. As a result, the spokes 218 are both weight-bearing and load-carrying structural elements. The centrifugal blower 26 includes a plurality of openings 222 arranged about the axis 38 and positioned between the hub 194 and the outer rim 202. Specifically, each of the openings 222 is defined by a combination of the hub 194, the outer rim 202, and two adjacent spokes 218. The openings 222 give the appearance that the middle of the centrifugal blower 26 is "open," rather than having a solid plate interconnecting the hub 194 and the outer rim 202. Such an open configuration of the blower 26 is known in the art as an "open-hub" centrifugal blower 26. Alternatively, the blower 26 may be configured as a "closed-hub" centrifugal blower, in which the openings 222 are omitted.

The centrifugal blower 26 also includes a plurality of cooling ribs 226 extending from the respective spokes 218 in a direction substantially parallel with the axis 38, toward a bottom end of the centrifugal blower 26. The illustrated blower 26 is integrally formed as a single piece (e.g., from a plastic material using a molding process). Alternatively, the blower 26 may be assembled from two or more pieces, and/or may be made from any of a number of different materials (e.g., a metal, a composite material, etc.).

In operation of the centrifugal blower assembly 10, the motor 18 drives the centrifugal blower 26 to create an airflow through the scroll 42. Most of the airflow created by the centrifugal blower 26 flows through the scroll 42 toward the outlet 34 of the volute 14. Some of the airflow in the scroll 42, however, is diverted from the scroll 42 to the cooling air passageway 78 via the inlet 82. Particularly, the side 182 of the inlet 82 is oriented substantially normal to the direction of the airflow B as it follows the contour of the first and second portions 114, 122 of the outer wall 110 (FIGS. 2 and 3). The second portion 122 of the wall 110 diverges gradually toward the central axis 38 to substantially prevent any separation of the airflow B (FIG. 3) from the second portion 122 of the outer wall 110. In this manner, the inlet path 134 directs the tangential airflow B toward the cooling airflow passageway 78 and uses the dynamic pressure of the tangential airflow B within the volute 42 to cool the motor 18.

The second side 186 of the inlet 82 is oriented generally parallel to the tangential airflow B in the volute 42 and cannot receive the airflow B in the same manner as the first side 182 of the inlet 82. However, the static pressure in the volute 42 in the vicinity of the second side 186 of the inlet 82 is sufficient to induce the radial airflow C through the second side 186 of the inlet 82 and directly into the cooling air passageway 78 to provide additional cooling to the motor 18.

From the inlet 82, the combined airflow (designated by the series of arrows A; FIG. 4) is directed through the cooling air passageway 78 toward the bottom end 90 of the motor 18. The airflow then exits the passageway 78 through the outlet 84 and is redirected upwardly, around the interior wall 94 of the housing 22, toward the top end 98 of the motor 18. As the airflow moves upwardly toward the top end 98 of the motor 18, the airflow flows through the interior of the can 46 to cool the internal components (e.g., the stator 48, the armature 49, commutator brushes, etc.) of the motor 18. The resultant heated airflow is drawn through the discharge opening 86 by the rotating cooling ribs 226. The heated airflow is subsequently re-introduced into the blades 210 of the centrifugal blower 26 for recirculation into the scroll 42. Alternatively, when a closed-hub centrifugal blower is utilized in the assembly 10, the heated airflow passing through the discharge opening 86 must flow around the lower plate of the closed-hub centrifugal blower prior to being recirculated into the scroll 42.

The cooling ribs 226 create a region of relatively low pressure proximate the discharge opening 86 during rotation of the blower 26. This, in conjunction with the dynamic pressure and the static pressure of the circulating airflow near the inlet 82 of the cooling air passageway 78, yields a larger pressure differential between the inlet 82 of the cooling air passageway 78 and the discharge opening 86 than what would otherwise result in the absence of the cooling ribs 226. By increasing the pressure differential between the inlet 82 of the cooling air passageway 78 and the discharge opening 86 in this manner, the flow rate of the airflow through the cooling air passageway 78 is increased, thereby enhancing the cooling effects on the motor 18. Alternatively, the cooling ribs 226 may be omitted if the airflow in the volute 42 that is generated by the blades 210 is sufficient to create a large enough pressure differential between the inlet 82 of the cooling air passageway 78 and the discharge opening 86 to provide sufficient cooling of the motor 18.

Various features of the invention are set forth in the following claims.

What is claimed is:

1. A motor housing for use with a centrifugal blower assembly, the motor housing comprising:

a motor support portion defining a central axis, and tangential and radial directions with respect to the central axis, the motor support portion including a first end and a second end;

a first wall surrounding the motor support portion;

a surface offset from the first wall toward the second end in a direction parallel with the central axis;

a cooling air passageway oriented generally parallel with the central axis and offset from the central axis, the cooling air passageway directing an airflow to the motor to cool the motor;

a second wall disposed radially outwardly of the first wall and oriented substantially normal to the first wall, at least a portion of the second wall deviating radially inwardly toward the central axis to define, in conjunction with the surface, an inlet path along which the airflow in the tangential direction may be directed, the inlet path widening in the tangential direction;

and an inlet opening directly into the cooling air passageway and being at least partially defined between the first wall and the surface, the inlet extending in a direction parallel with the central axis, the inlet having a first side coinciding with an end of the inlet path through which the airflow in the tangential direction may directly enter the cooling air passageway, and the inlet having a second side generally perpendicular to the first side through which the airflow in the radial direction may directly enter the cooling air passageway.

2. The motor housing of claim 1, wherein the cooling air passageway is at least partially defined by a first surface at least partially bounded by a first edge, and a second surface at least partially bounded by a second edge oriented substantially normal to the first edge, wherein the inlet is at least partially defined by the first and second edges.

3. The motor housing of claim 2, wherein the second wall is disposed adjacent the first wall, and wherein the second wall includes a first portion defining at least a portion of a cylinder coaxial with the central axis, and a second portion spanning between the inlet and the first portion, wherein the second portion deviates from the cylinder radially inwardly in a direction toward the central axis.

4. The motor housing of claim 3, wherein the second portion of the second wall is arcuate.

5. The motor housing of claim 3, wherein the second portion of the second wall includes a third edge defining a portion of the inlet.

6. The motor housing of claim 5, further comprising a third wall adjacent the second wall and oriented substantially parallel with the first wall, the third wall including the surface and a fourth edge, and a ramp at least partially bounded by the first and fourth edges.

7. The motor housing of claim 5, wherein the second wall includes a fourth edge at least partially defining a first side of the inlet.

8. The motor housing of claim 7, wherein the third edge of the second wall defines a second side of the inlet.

9. The motor housing of claim 8, wherein the first wall includes a fifth edge adjacent the third edge, and a sixth edge adjacent the fourth edge and oriented substantially normal to the fifth edge, wherein the fifth and sixth edges at least partially define the inlet.

10. A centrifugal blower assembly comprising:

a volute;

a motor housing coupled to the volute, the motor housing including motor support portion defining a central axis, and tangential and radial directions with respect to the central axis, the motor support portion including a first end and a second end, a first wall surrounding the motor support portion, a surface offset from the first wall toward the second end in a direction parallel with the central axis, a cooling air passageway oriented generally parallel with the central axis and offset from the central axis, the cooling air passageway directing an airflow to the motor to cool the motor, a second wall disposed radially outwardly of the first wall and oriented substantially normal to the first wall, at least a portion of the second wall deviating radially inwardly toward the central axis to define, in conjunction with the surface, an inlet path along which the airflow in the tangential direction may be directed, the inlet path widening in the tangential direction, and an inlet opening directly into the cooling air passageway and being at least partially defined between the first wall and the surface, the inlet extending in a direction parallel with the central axis, the inlet having a first side coinciding with an end of the inlet path through which the airflow in the tangential direction may directly enter the cooling air passageway, and the inlet having a second side generally perpendicular to the first side through which the airflow in the radial direction may directly enter the cooling air passageway;

a motor supported by the motor housing and having an output shaft; and a centrifugal blower coupled to the output shaft for co-rotation with the output shaft.

11. The centrifugal blower assembly of claim 10, wherein the cooling air passageway is at least partially defined by a first surface at least partially bounded by a first edge, and a second surface at least partially bounded by a second edge oriented substantially normal to the first edge, wherein the inlet is at least partially defined by the first and second edges.

12. The centrifugal blower assembly of claim 11, wherein the second wall is disposed adjacent the first wall, and wherein the second wall includes a first portion defining at least a portion of a cylinder coaxial with the central axis, and a second portion spanning between the inlet and the first portion, wherein the second portion deviates radially inwardly from the cylinder in a direction toward the central axis.

13. The centrifugal blower assembly of claim 12, wherein the second portion of the second wall is arcuate.

14. The centrifugal blower assembly of claim 12, wherein the second portion of the second wall includes a third edge defining a portion of the inlet.

15. The centrifugal blower assembly of claim 14, further comprising a third wall adjacent the second wall and oriented substantially parallel with the first wall, the third wall including the surface and a fourth edge, and a ramp at least partially bounded by the first and fourth edges.

16. The centrifugal blower assembly of claim 14, wherein the second wall includes a fourth edge at least partially defining a first side of the inlet.

17. The centrifugal blower assembly of claim 16, wherein the third edge of the second wall defines a second side of the inlet.

18. The centrifugal blower assembly of claim 17, wherein the first wall includes a fifth edge adjacent the third edge, and a sixth edge adjacent the fourth edge and oriented substantially normal to the fifth edge, wherein the fifth and sixth edges at least partially define the inlet.

19. The centrifugal blower assembly of claim 10, wherein the first wall is in facing relationship with the centrifugal blower.

20. The centrifugal blower assembly of claim 10, wherein the centrifugal blower defines an outermost radius, and wherein the inlet is disposed within a cylinder coinciding with the outermost radius of the centrifugal blower.

* * * * *